US005440983A

United States Patent [19]

Döpke et al.

[11] Patent Number: 5,440,983

[45] Date of Patent: Aug. 15, 1995

[54] SWINGING PREGRIPPER OF A SHEET-FED PRINTING PRESS

[75] Inventors: Stefan Döpke, Eppelheim; Andreas Fricke, Eberbach, both of Germany

[73] Assignee: Heidelberger Druckmaschinen, Heidelberg, Germany

[21] Appl. No.: 302,631

[22] Filed: Sep. 8, 1994

[30] Foreign Application Priority Data

Sep. 8, 1993 [DE] Germany ..... 43 30 392.7

[51] Int. Cl.[6] ..... B41F 1/30

[52] U.S. Cl. ..... 101/410; 271/206; 271/268; 271/277; 101/242; 101/232

[58] Field of Search ..... 101/408, 409, 410, 232, 101/415.1, 137, 242; 271/275, 276, 277, 82, 196, 183, 184, 185, 186, 206, 268

[56] References Cited

U.S. PATENT DOCUMENTS

| | | | |
|---|---|---|---|
| 3,903,795 | 9/1975 | Suzuki | 101/415.1 |
| 3,992,993 | 11/1976 | Kühn et al. | 101/409 |
| 4,052,055 | 10/1977 | Jirus | 271/268 |
| 4,290,595 | 9/1981 | Thünker | 271/277 |
| 4,311,093 | 1/1982 | Abendroth et al. | 101/232 |
| 4,370,928 | 2/1983 | Weisbach et al. | 101/242 |
| 5,076,165 | 12/1991 | Pollich | 101/409 |
| 5,125,336 | 6/1992 | Germann | 101/410 |
| 5,142,983 | 9/1992 | Kobler et al. | 101/409 |
| 5,343,806 | 9/1994 | Fricke et al. | 101/408 |

FOREIGN PATENT DOCUMENTS

| | | | |
|---|---|---|---|
| 2851263 | 9/1979 | Germany . | |
| 3037776 | 7/1981 | Germany | 101/410 |
| 3536535 | 6/1986 | Germany . | |
| 3736808 | 9/1988 | Germany . | |
| 4108482 | 10/1991 | Germany . | |
| 2015483 | 9/1979 | United Kingdom . | |

*Primary Examiner*—Eugene H. Eickholt

*Attorney, Agent, or Firm*—Herbert L. Lerner; Laurence A. Greenberg

[57] ABSTRACT

Gripper control for a cyclically swingably driven pregripper for transporting single sheets in a sheet-fed printing press, the pregripper having at least one sheet gripper mounted on a free end of a swivel lever motorizingly pivotable about a frame-fixed swivel shaft, the gripper control including cams for forcibly moving the sheet gripper about an articulated shaft oriented parallel to the swivel shaft so as to close and open the sheet gripper upon sheet acceptance and sheet transfer, one of the cams being revolvable in a single revolution for cyclically shifting the other of the cams in the position thereof, the other of the cams being secured to a roller lever supported pivotally at a fixed location and having a cam roller resting on the one cam, relative positions of the cams being adjustable for determining the instants of closing and opening of the gripper, the other of the cams being a cam segment having two successive circular cam regions with radii of curvature of different length and a common center point, the cam segment being adjustable equidistantly to the circular cam regions with respect to the roller lever, the one cam revolving in a single revolution being effective for opening the gripper and the cam segment being effective for closing the gripper.

4 Claims, 5 Drawing Sheets

SWINGING PREGRIPPER OF A SHEET-FED PRINTING PRESS

SPECIFICATION

Figure 1:
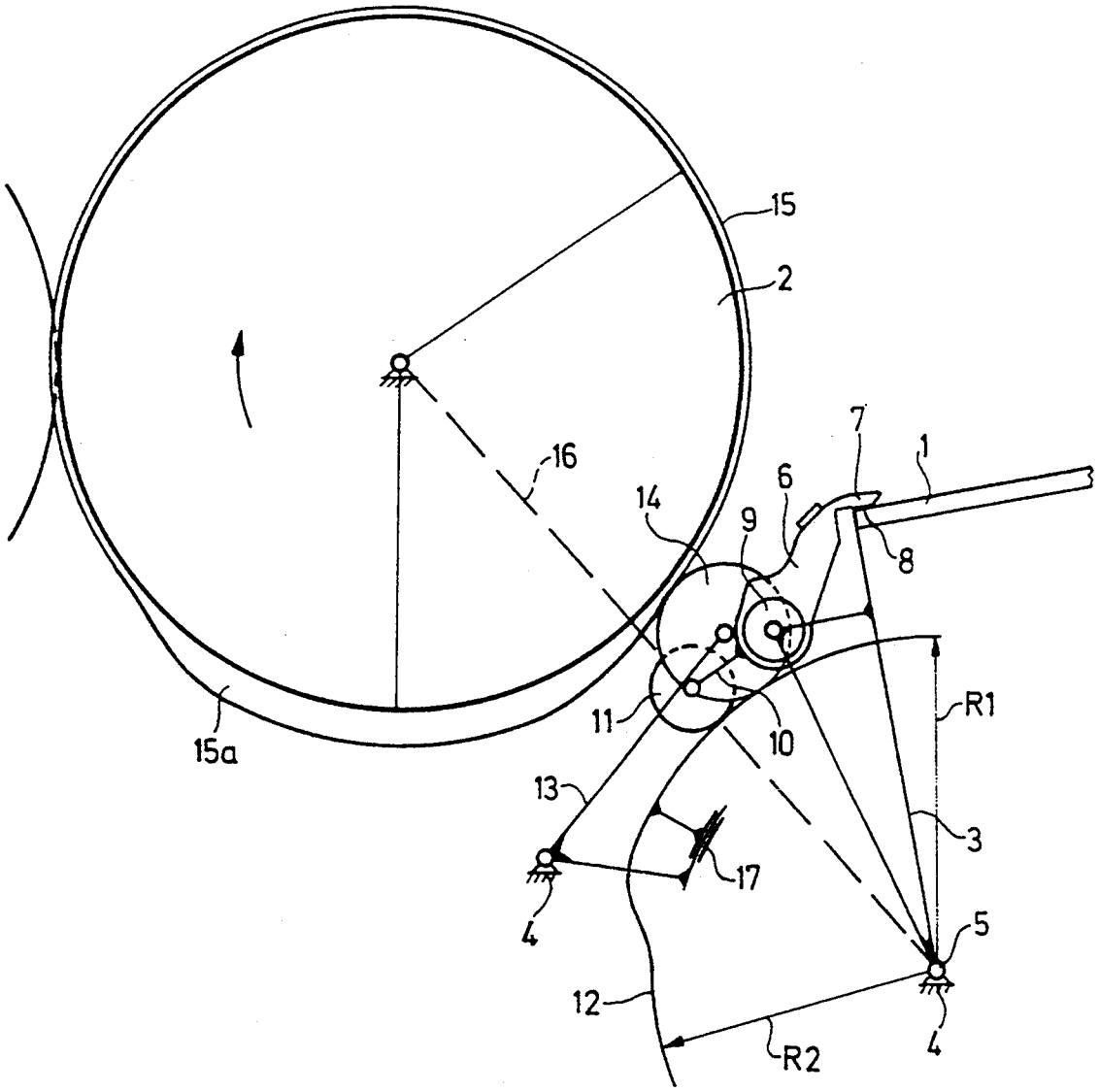
Figure 2:
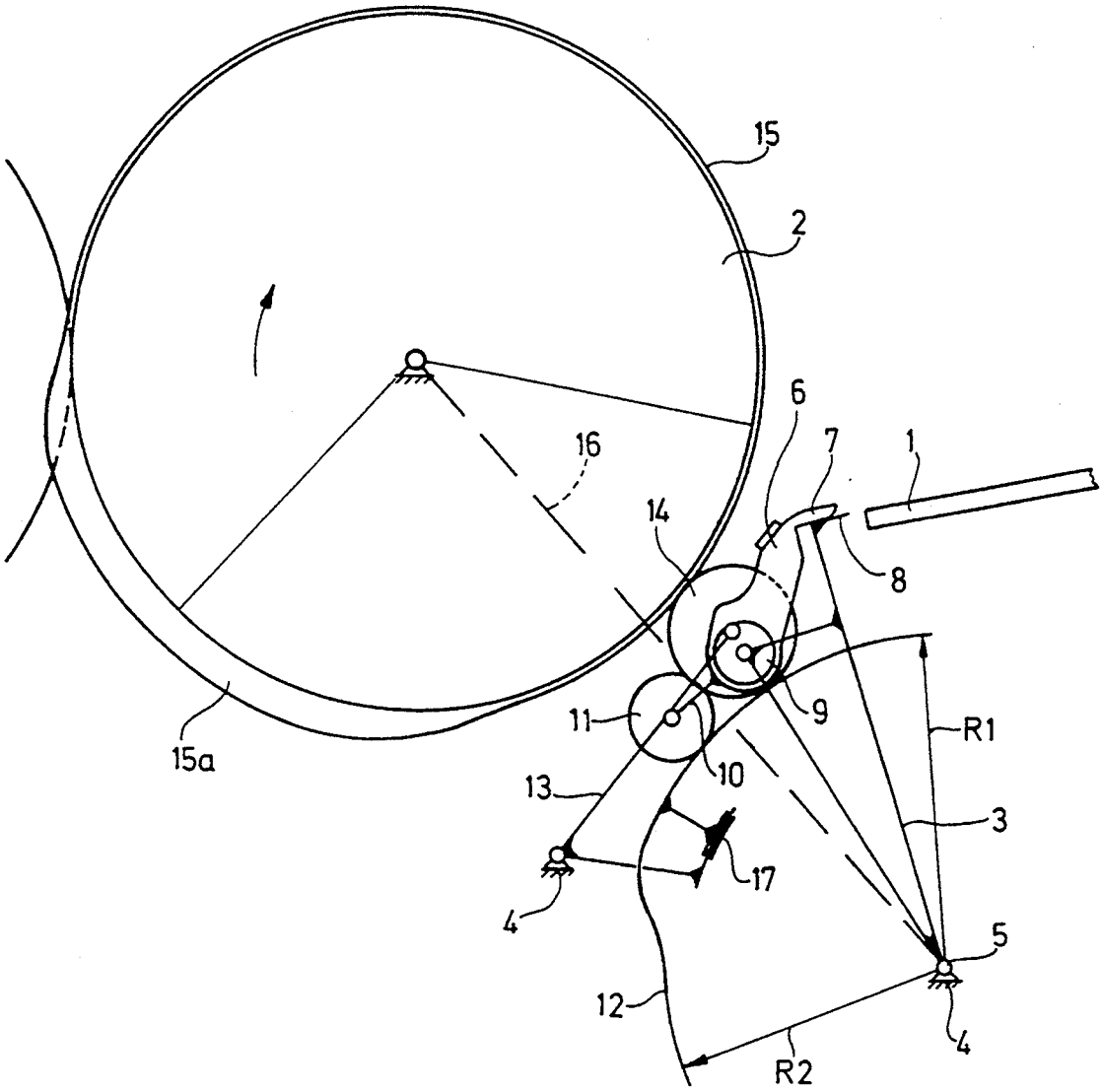
Figure 3:
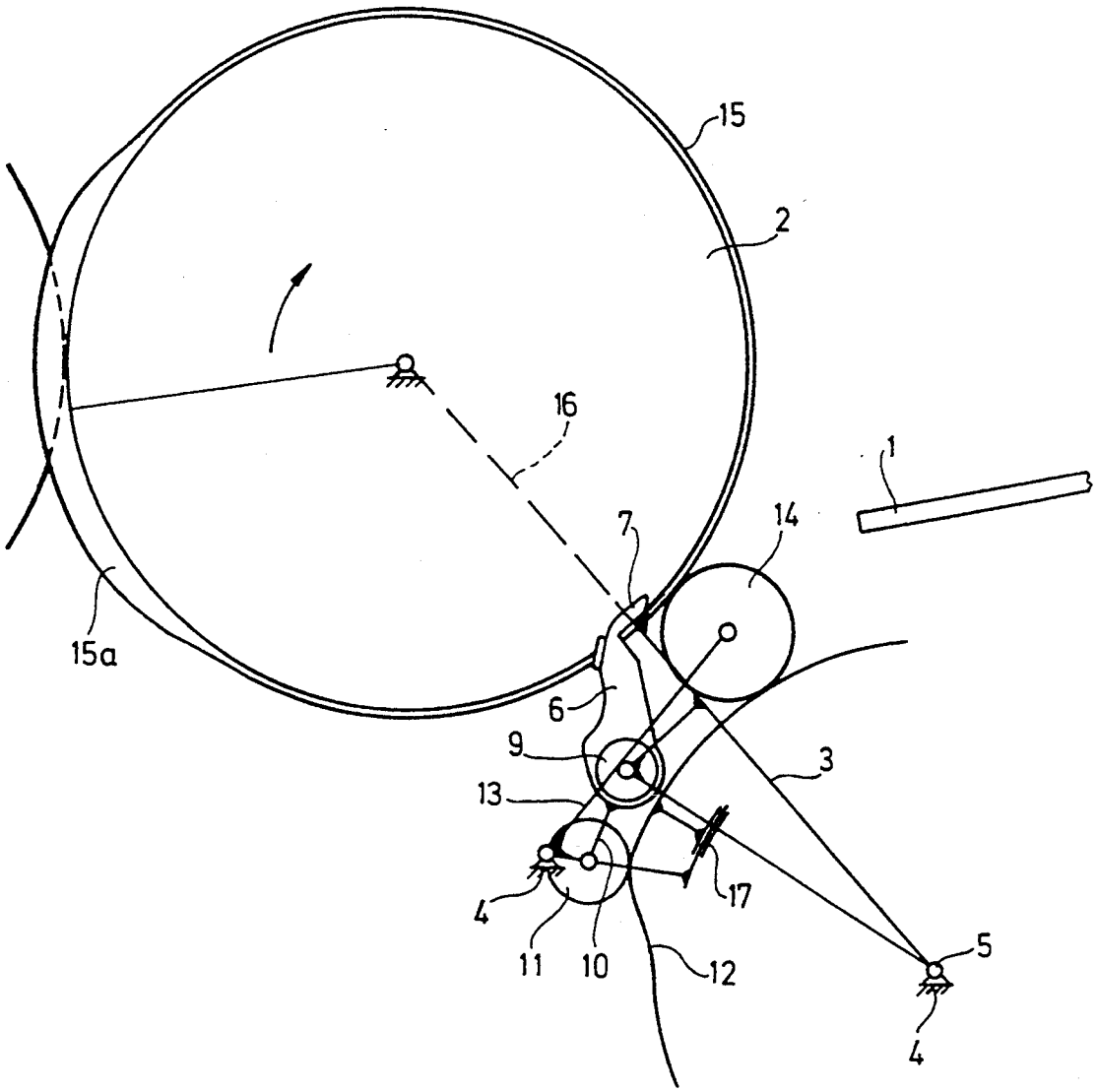
Figure 4:
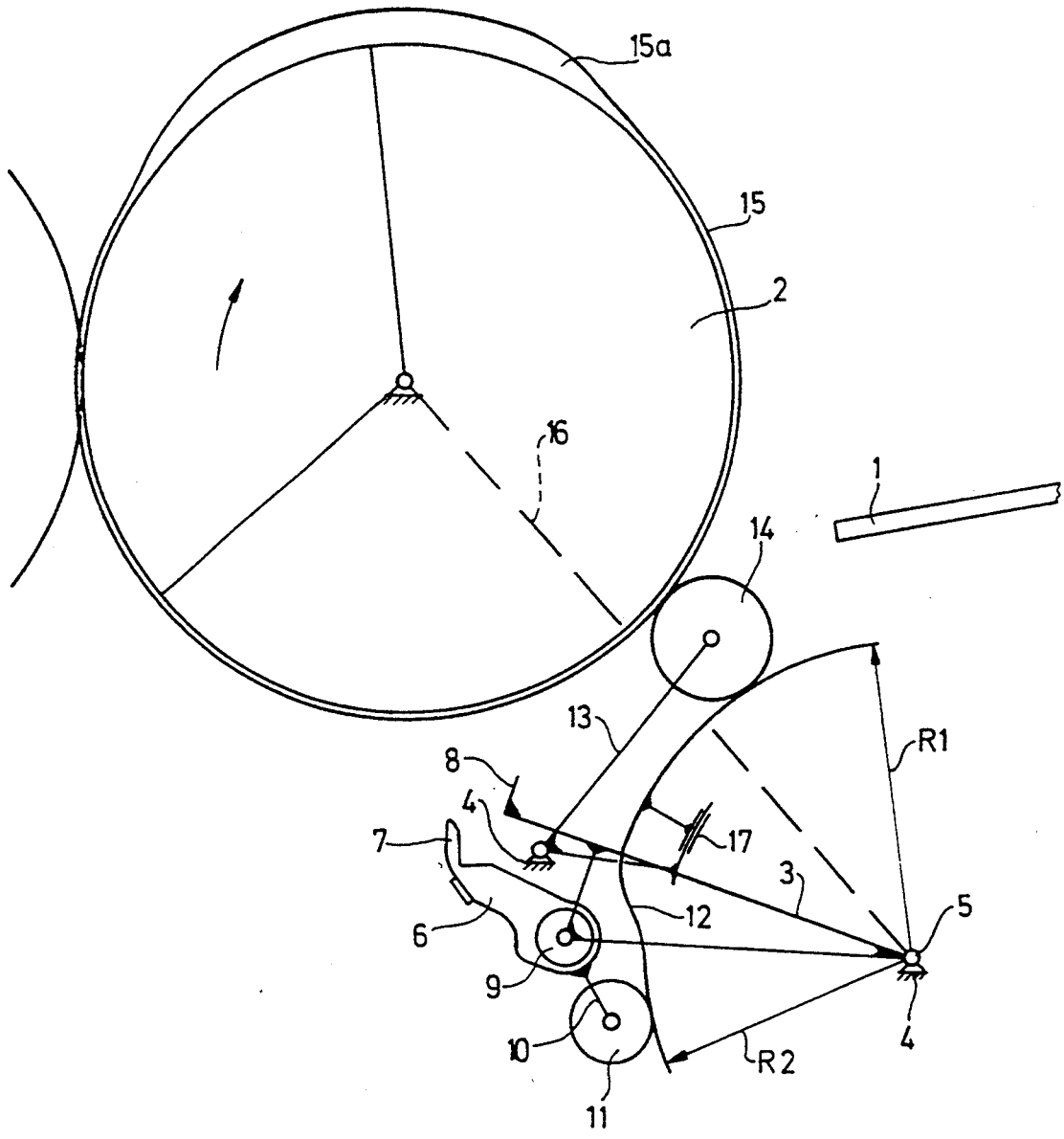
Figure 5:
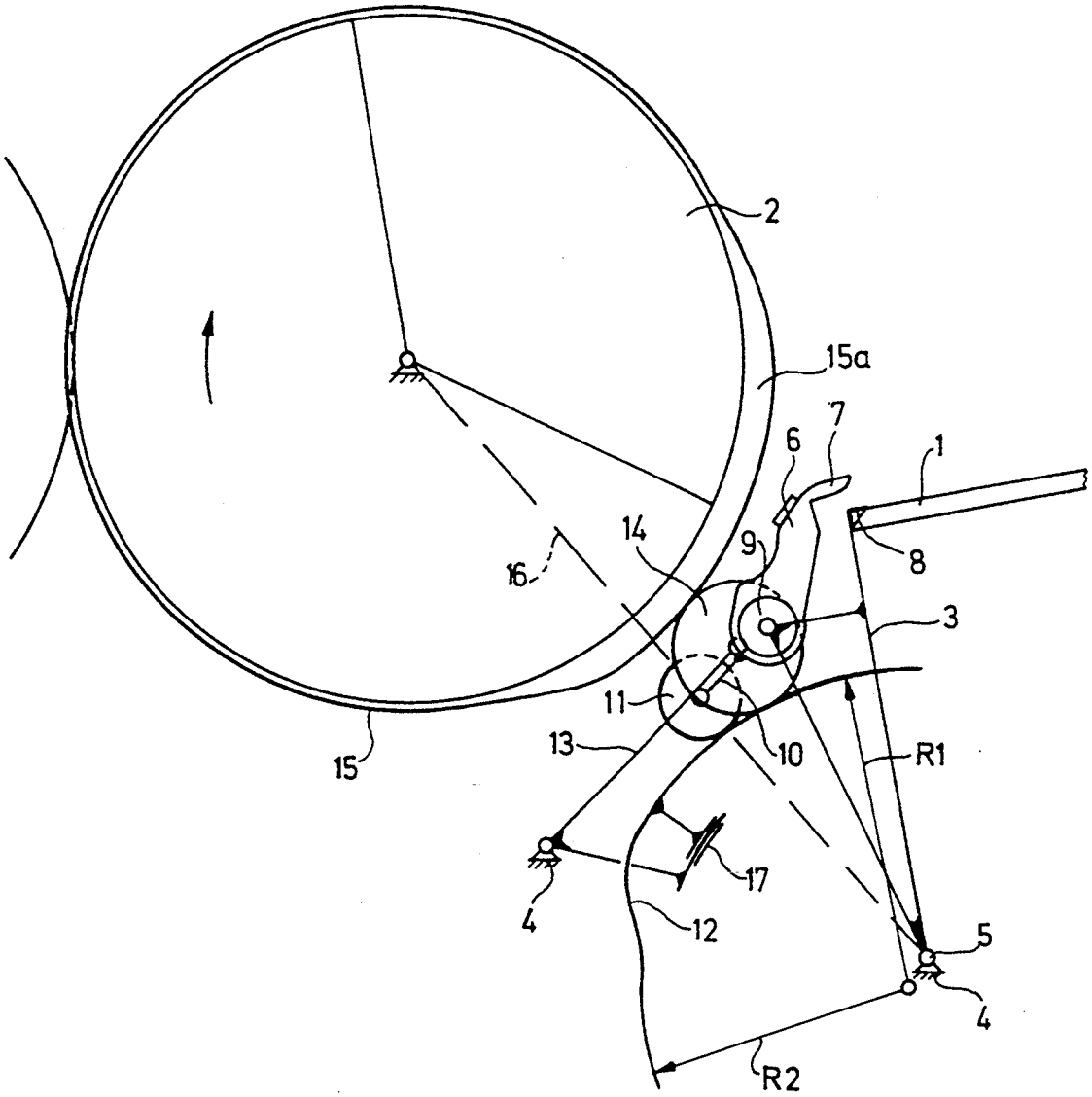

The invention relates to a gripper control for a cyclically swingably driven pregripper for transporting single sheets in a sheet-fed printing press, the pregripper having at least one sheet gripper mounted on a free end of a swivel lever motorizingly pivotable about a frame-fixed swivel shaft, the gripper control including cams for forcibly moving the sheet gripper about an articulated shaft oriented parallel to the swivel shaft so as to close and open the sheet gripper upon sheet acceptance and sheet transfer.

A pregripper, for the control of which such structural features are provided, has become known heretofore from German Published, Non-Examined Patent Application (DE-OS) 28 51 263.

Sheet conveyance by the pregripper should to take place exactly at a predetermined press angle, so as to accelerate the sheets, aligned in most cases on a delivery table, to press speed by means of the pregripper and then to feed them in register onto a cylinder of a printing unit for guiding the sheet onward, so that the gripper system of the printing unit can grip the leading edge of the sheet in register. There most be no phase deviations between the acceptance or takeover of the sheet by the pregripper and the transfer position to the gripper system of the cylinder which carries the sheet onward. Inaccuracies in manufacture, errors in installation or assembly, and properties of the material of both the pregripper and the transmission elements effecting the motions thereof produce errors in transmission performance, which cause deviations in the closing and opening times and hence result in mis-registers. To minimize such phenomena, conventional pregrippers permit adjustments of the gripper closing and opening times after installation or assembly. Such an adjustment is performed either by means of an iterative procedure for correcting any deviations in the closing and opening times, so as to minimize the errors in the totality thereof. The cause resides in the kinematic feedback of the adjustment of the instant of closing upon the instant of opening and the reverse thereof, respectively. Accordingly, some random residual error always remains. Practical embodiments of sheet-fed printing presses from various manufacturers have already been provided with adjusting devices which permit separate adjustment of the instant of closing and the instant of opening of the sheet gripper without producing any effect upon one another. Adjusting cams are used for this purpose. These devices also have the deficiency of the kinematic feedback in the adjustment of the instant of closing time to the instant of opening and the reverse, respectively. Split or divided gripper control cams which permit an independent adjustment of the opening and closing times have also become known heretofore. The use or application thereof involves a very great technological effort and expense, however, in order to assure the necessary running quality at the transition of the cam roller from one cam segment to the other.

It is accordingly an object of the invention to provide a gripper control of the type described in the introduction hereto which, at a minimum expense for parts and manufacturing, is constructed so that mutually independent adjustment of the instant of closing and the the instant of opening of the gripper can be performed without any kinematic feedback having any practical effect.

With the foregoing and other objects in view, there is provided, in accordance with the invention, a gripper control for a cyclically swingably driven pregripper for transporting single sheets in a sheet-fed printing press, the pregripper having at least one sheet gripper mounted on a free end of a swivel lever motorizingly pivotable about a frame-fixed swivel shaft, the gripper control including cams for forcibly moving the sheet gripper about an articulated shaft oriented parallel to the swivel shaft so as to close and open the sheet gripper upon sheet acceptance and sheet transfer, one of the cams being revolvable in a single revolution for cyclically shifting the other of the cams in the position thereof, the other of the cams being secured to a roller lever supported pivotally at a fixed location and having a cam roller resting on the one cam, relative positions of the cams being adjustable for determining the instants of closing and opening of the gripper, the other of the cams comprising a cam segment having two successive circular cam regions with radii of curvature of different length and a common center point, the cam segment being adjustable equidistantly to the circular cam regions with respect to the roller lever, the one cam revolving in a single revolution being effective for opening the gripper and the cam segment being effective for closing the gripper.

The cam revolving with a single revolution and disposed, for example, on the shaft of the cylinder accepting the sheet thereby permits the attainment of an exact adjustment of the instant of closing of the gripper at the location of sheet acceptance or takeover, without having this adjustment kinematically affect the adjustment of the instant of opening of the gripper at the location of sheet transfer to the gripper system of the cylinder. This instant of opening of the gripper is determined by a different cam, which becomes operative as a function of the swivel angle of the pregripper. That cam is connected to a roller lever which, on the one hand, is supported swivelably at a fixed location of the frame and, on the other hand, rests with a cam roller against the one cam revolving with a single revolution, so that an adjustment of the one cam relative to the roller lever produces a change in the opening time upon sheet transfer yet remains without influence upon the gripper motion at sheet acceptance or takeover.

An advantageous embodiment of the invention resides in the fact that the center point of the circular cam regions of the displaceable cam, upon sheet transport from the feeder table to the cylinder, is located on the swing shaft, and that the one cam revolving with a single revolution, which is effective for gripper motion at the location of sheet acceptance or takeover, shifts this center point during the gripper motion. For the same purpose, the sheet gripper supported movably on a shaft on the swing lever is rigidly joined to a roller lever having a cam roller mounted on a free end thereof by means of which it is braced against the shiftable cam formed with the circular cam regions which succeed one another via a transition.

Thus, in accordance with another feature of the invention, the gripper control includes retainer elements formed as circular arcs interengaging with the roller lever movable by the cam revolving with a single revolution and the cam segment secured to the roller lever, and being adjustable relative to one another and connectable fixedly to one another.

In accordance with a further feature of the invention, the circular arc-like cam regions of the cam segment have a center of rotation located on the swivel shaft, the center of rotation being shiftable by the one cam.

In accordance with a concomitant feature of the invention, the sheet gripper is movably mounted on a swivel arm fixedly connected to a roller lever having a free end, the roller lever being braced through the intermediary of a cam roller rotatably mounted at the free end of the roller lever against a cam flank of the cam segment.

Other features which are considered as characteristic for the invention are set forth in the appended claims.

Although the invention is illustrated and described herein as embodied in a swinging pregripper of a sheet-fed printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIGS. 1 to 5 are diagrammatic and schematic fragmentary side elevational views of a sheet-fed printing press showing a pregripper in various phases of operation thereof.

Referring now to the figures of the drawing, there is shown therein a pregripper for sheet transport located between a delivery table 1 and a sheet-accepting cylinder 2 and formed of a schematically represented swivel arm 3 having a lower end supported in a frame 4 so as to be movable about a swivel shaft extending transversely to the direction of sheet feeding, and a sheet gripper 6 with a gripper prong or finger 7 which, when the gripper 6 is closed, firmly holds the sheet, in the region of the leading edge thereof, against a gripper rest or pad 8. The sheet gripper 6 is disposed on a gripper shaft 9 supported on the swivel arm 3 and is rigidly joined to a roller lever 10 which, at a free end thereof, rotatably supports a cam roller 11 which rolls on a cam segment 12. Suitably, this cam segment 12 has two successive cam regions with different diameters R1 and R2, and a transitional region located therebetween. This cam segment 12 is secured adjustably to one arm of a further roller lever 13, which is supported on the frame 4 so as to be movable about an articulated shaft disposed parallel to the swivel shaft. A cam roller 14 is rotatably supported on the free end of this roller lever 13 and rolls on the circumference of a single-revolution cam 15 and, for example, is disposed on the shaft of the cylinder 2. To secure the cam segment 12 to the arm of the roller lever 13, retention members 16 are used on the cam segment 12 and on the arm of the roller lever 13, which mesh with one another in the form of circular arcs, so that the cam segment 12 is adjustable relative to the roller lever 13 equidistantly from the circular arc-like cam regions R1 and R2.

In the schematic drawing of FIG. 1, the sheet to be transported is located with the leading edge thereof in the closed gripper 6. The pregripper then swivels the sheet, accelerating it to printing speed, to the transfer position represented by the broken line 16, wherein the non-illustrated gripper system of the cylinder 2 engages the leading edge of the sheet. In order to leave the gripper in the closed state thereof, the cam segment 12 has the radius R1, the center point of which in this motion segment coincides with the swivel shaft 5 of the swivel arm 3. The cam segment 12 can accordingly rest relative to the frame 4. The gripper control cam 12 revolving in a single revolution with the cylinder 2 determines the motion of the roller lever 13. Over a predominant region, this cam 12 is formed circular arc-like and concentric with the center of rotation 5.

The instant the pregripper with the leading edge of the sheet has reached the transfer position at the line 16, the gripper opens. This is effected at the transition from the cam flank having the larger radius R1 to the cam flank having the smaller radius R2, through which the cam roller 11 passes on the roller lever 10 with which the gripper 6 is connected. After the sheet transfer, the pregripper swings onward to the final position thereof shown in FIG. 4. The gripper remains opened, because the cam roller 11 then rolls on the cam flank having the smaller radius R2. The center points of the two radii R1 and R2 coincide. In the reverse motion of the pregripper, the gripper 6 is closed in the region of the sheet transfer position to avoid a collision with the cylinder 2. The closing motion of the gripper is forcibly effected by the running up of the cam roller 11 from the smaller radius R2 onto the cam region having the larger radius R1. For a collision-free return of the sheet gripper, the cylinder 2 must also be provided with suitable non-illustrated recesses. Before the sheet gripper reaches the feeder table 1 again, the gripper 6 must be opened. The cam roller 14 consequently runs from the circular arc-like cam portion onto the raised control cam portion 15*a*, so that the roller lever 13 and thus the cam segment 12, as well, are rotated clockwise about the axis of the articulation at the frame 4. This motion is also followed by the cam roller 11 rolling on the cam flank of the cam segment 12, whereby the roller lever 10 is deflected in the opposite direction at the sheet gripper 6, and the gripper 6 opens. The instant the pregripper has reached the acceptance or takeover position thereof at the feeder table 1, and the next sheet is located with the leading edge thereof between the gripper rest or pad 8 and the gripper prong or finger 7, the cam roller 14 runs from the high region 15*a* onto the circular cam region 15, so that the gripper 6 is closed by the motion of the cam roller. The center points of the radii R1 and R2 are then once again located on the swivel shaft 5.

Because of the functional separation of the elements for gripper opening and gripper closure, the adjustment of the instant of gripper opening can be performed by displacing the cam segment 12 relative to the arm of the roller lever 13 in the retainer element 17 with ensuing locking. The center point of curvature of the retainer elements 17 must for that purpose be concentric with the center point of the radii R1 and R2. After this adjustment, the adjustment of the instant of gripper closing is performed by a suitable rotation of the gripper control cam 15 on the shaft of the cylinder 2. The described adjustment effects merely a temporal phase displacement or shift in the courses of motion for gripper closing and gripper opening, respectively, for effecting a sheet acceptance and a sheet transfer, respectively. The implemented dynamically optimized laws of motion are not violated thereby.

We claim:

1. Gripper control for a cyclically swingably driven pregripper for transporting single sheets in a sheet-fed printing press, the pregripper having at least one sheet gripper mounted on a free end of a swivel lever motorizingly pivotable about a frame-fixed swivel shaft, the gripper control including cams for forcibly moving the sheet gripper about an articulated shaft oriented parallel to the swivel shaft so as to close and open the sheet gripper upon sheet acceptance and sheet transfer, one of the cams being revolvable in a single revolution for cyclically shifting the other of the cams in the position thereof, the other of the cams being secured to a roller lever supported pivotally at a fixed location and having a cam roller resting on the one cam, relative positions of the cams being adjustable for determining the instants of closing and opening of the gripper, the other of the cams comprising a cam segment having two successive circular cam regions with radii of curvature of different length and a common center point, said cam segment being adjustable equidistantly to the circular cam regions with respect to the roller lever, the one cam revolving in a single revolution being effective for opening the gripper and said cam segment being effective for closing the gripper.

2. Gripper control according to claim 1, including retainer elements formed as circular arcs interengaging with said roller lever movable by said cam revolving with a single revolution and said cam segment secured to said roller lever, and being adjustable relative to one another and connectable fixedly to one another.

3. Gripper control according to claim 1, wherein said circular arc-like cam regions of said cam segment have a center of rotation located on said swivel shaft, said center of rotation being shiftable by the one cam.

4. Gripper control according to claim 1, wherein the sheet gripper is movably mounted on a swivel arm fixedly connected to a roller lever having a free end, said roller lever being braced through the intermediary of a cam roller rotatably mounted at said free end of said roller lever against a cam flank of said cam segment.

* * * * *